US009577380B1

(12) United States Patent
Zhao

(10) Patent No.: US 9,577,380 B1
(45) Date of Patent: Feb. 21, 2017

(54) CONNECTOR

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Jiang Zhao, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/946,014

(22) Filed: Nov. 19, 2015

(30) Foreign Application Priority Data

Aug. 25, 2015 (CN) ..... 2015 1 0525370

(51) Int. Cl.
*H01R 13/62* (2006.01)
*H01R 24/00* (2011.01)
*H01R 13/635* (2006.01)

(52) U.S. Cl.
CPC ..... *H01R 13/635* (2013.01)

(58) Field of Classification Search
CPC ..... H01R 12/716; H01R 12/52; H01R 13/26; H01R 24/62; H01R 13/635; H01R 12/7005; H01R 13/6335; H01R 13/629
USPC ..... 439/159, 660, 74, 65
See application file for complete search history.

(56) References Cited

U.S. PATENT DOCUMENTS 7,658,636 B2 * 2/2010 Takeuchi ..... H01R 13/6275 439/357
8,052,457 B2 * 11/2011 Miyazaki ..... H01R 13/6275 439/357
8,257,095 B2 * 9/2012 Akai ..... H01R 12/716 439/248
9,039,428 B2 * 5/2015 Sasaki ..... H01R 12/716 439/74
9,190,751 B2 * 11/2015 Miyazaki ..... H01R 12/716

* cited by examiner

*Primary Examiner* — Xuong Chung Trans
(74) *Attorney, Agent, or Firm* — Zhigang Ma

(57) ABSTRACT

A connector includes a plug and a receptacle. The plug includes a first main body which includes a groove and two slot walls with a number of first terminals. The receptacle includes a support, a second main body and an insert. The second main body includes a rail matching with the groove of the plug. The rail includes two flanks and each flank includes a number of second terminals corresponding to the first terminals. When the first main body slides into the second main body via the rail and holds the support, each first terminal on the slot wall of the first main body connects to one second terminal on each flank of the rail to make the plug electrically connect to the receptacle.

10 Claims, 8 Drawing Sheets

CONNECTOR

CROSS-REFERENCE TO RELATED APPLICATIONS

This application claims priority to Chinese Patent Application No. 201510525370.1 filed on Aug. 25, 2015, the contents of which are incorporated by reference herein.

FIELD

The subject matter herein generally relates to a connector, and particularly, to a connector configured to insert a connector plug into a connector receptacle from horizontal direction.

BACKGROUND

The connecting mode between a plug and a receptacle can be a vertical insert mode. However, when the plug connects with the receptacle by the vertical insert mode, such as an insert pull connector, terminals of the plug of the insert pull connector may not match terminals of the receptacle of the insert pull connector, causing the terminals of the plug and the receptacle to be damaged.

BRIEF DESCRIPTION OF THE DRAWINGS

Implementations of the present technology will now be described, by way of example only, with reference to the attached figures.

DETAILED DESCRIPTION

Figure 1:
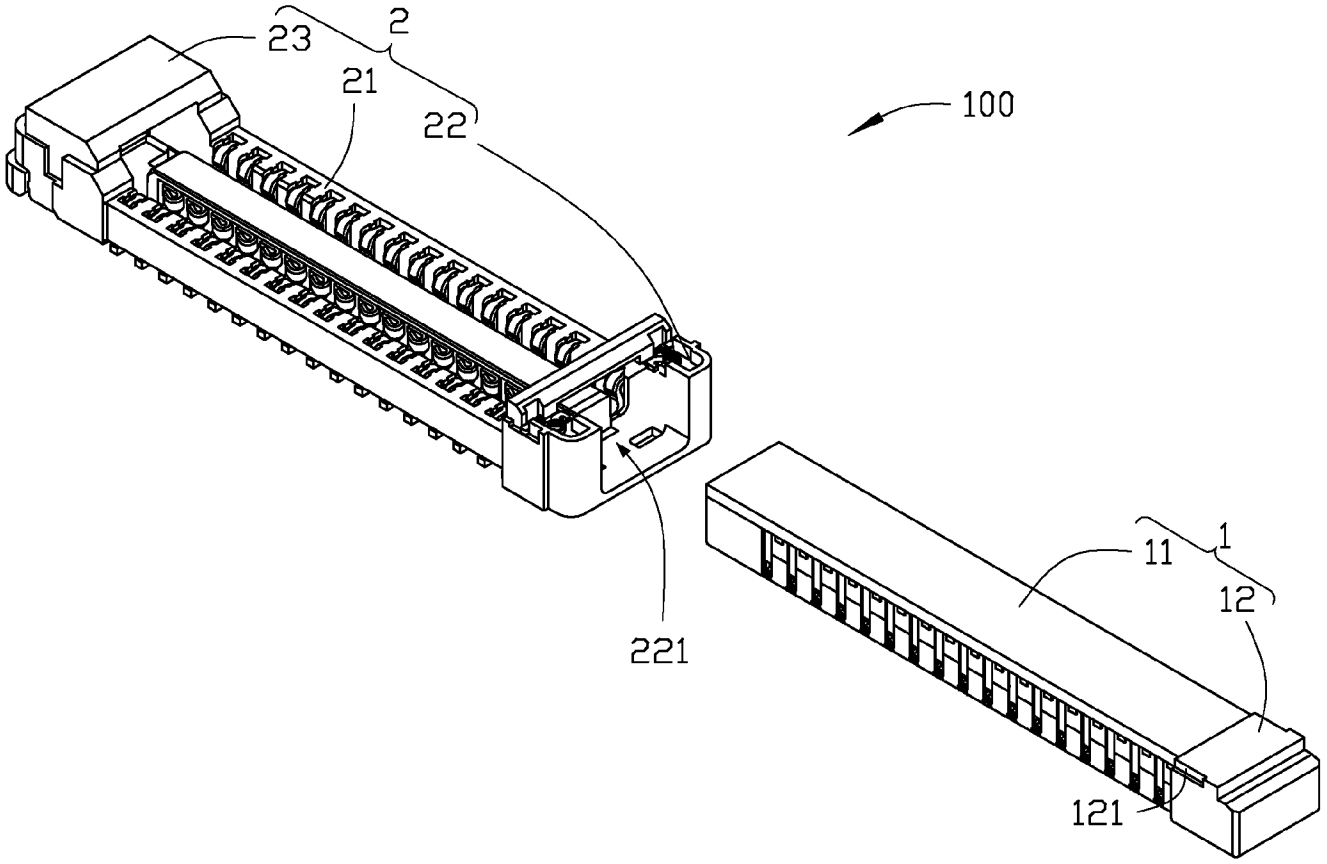
FIG. 1 is an isometric view showing an embodiment of a connector of one angle of view.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series and the like.

Embodiments of the present disclosure will be described in relation to the accompanying drawings.

Figure 2:
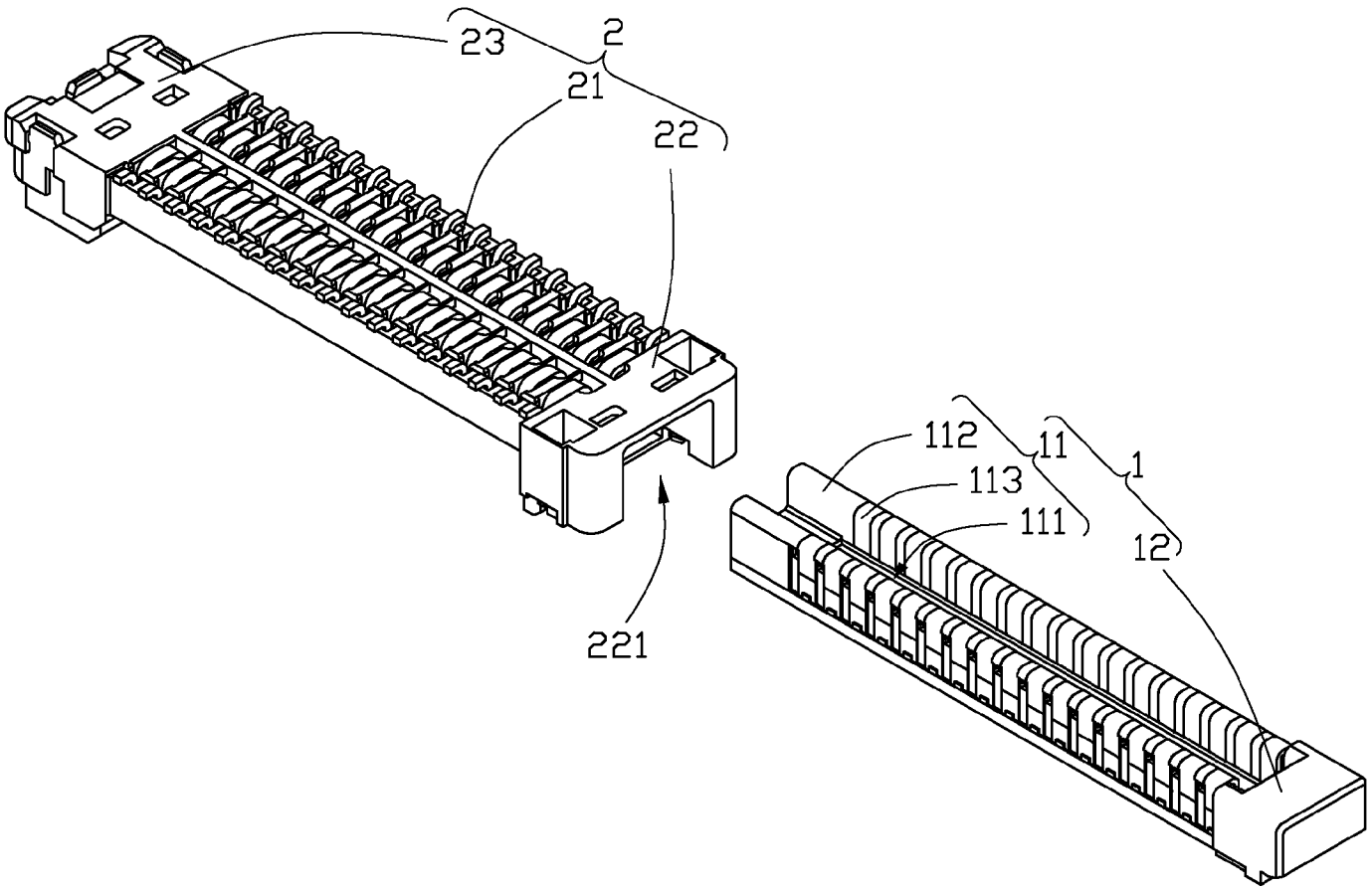
FIG. 2 is an isometric view showing an embodiment of a connector of another angle of view of FIG. 1.
Figure 3:
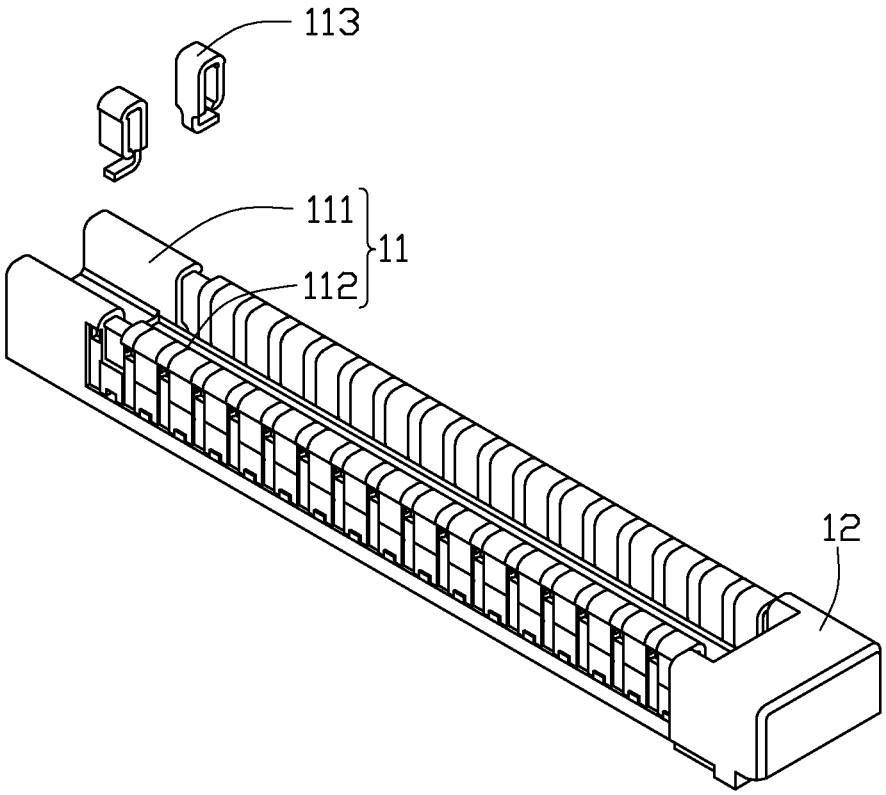
FIG. 3 is a partial exploded, isometric view showing an embodiment of a plug of FIG. 2.

FIGS. 1-2 illustrate an embodiment of a connector 100. The connector 100 includes a plug 1 and a receptacle 2. The plug 1 includes a first main body 11 and a push 12 connecting with the first main body 11. In at least one embodiment, the first main body 11 and the push 12 are integrally molded. FIG. 3 illustrates the first main body 11 includes a groove 111 and two slot walls 112. Each slot wall 112 sets a number of first terminals 113. The first terminal 113 is a metal contact having a conductive function. The push 12 is configured for a user to manually push the plug 1 into the receptacle 2 or pull the plug 1 from the receptacle 2. In at least one embodiment, the push 12 is a bump.

Figure 4:
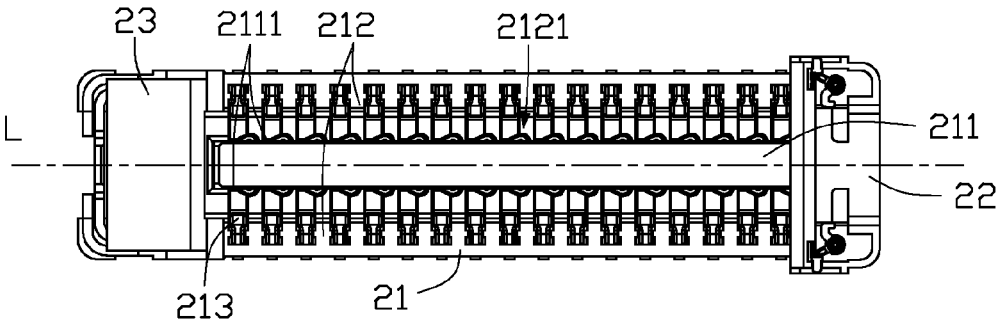
FIG. 4 is a top, isometric view showing an embodiment of a receptacle of FIG. 1.

FIG. 4 illustrates a top, isometric view showing an embodiment of a receptacle 2 of FIG. 1. In at least one embodiment, the receptacle 2 includes a second main body 21, an insert 22, and a support 23. One end of the second main body 21 is connected to the insert 22; the other end of the second main body 21 is connected to the support 23. The insert 22 sets a first gap 221. The first main body 11 can be pushed into the second main body 21 via the first gap 221. When the first main body 11 is pushed into the second main body 21 via the first gap 221, the support 23 holds the first main body 11 and the push 12 is received in the first gap 221. In at least one embodiment, the receptacle 21, the insert 22 and the support 23 are integrally molded. Both the insert 22 and the support 23 are a bump.

The second main body 21 sets a rail 211 along a major axis L of the receptacle 21. The groove 111 matches the rail 211 and the first main body 11 can slide into the receptacle 21 via the rail 211. The second main body 21 sets two side walls 212 along a direction parallel to the major axis L. There emerges a first accommodation space 2121 between the rail 211 and each side wall 212. The first accommodation space 2121 is used to receive the slot wall 112 of the first main body 11. The rail 211 includes two flanks 2111. Each flank 2111 includes a number of second terminals 213 along the direction parallel to the major axis L. Therein, the number of the second terminals 213 on each flank 2111 is equal to the number of the first terminals 113 on each slot wall 112 and each second terminal 213 on each flank 2111 corresponds to one first terminal 113. In at least one embodiment, the second terminal 213 is a metal contact having a conductive function. When the first main body 11 is pushed into the second main body 21 via the rail 211 and is held by the support 23, each first terminal 113 connects to one second terminal 113, thus, the plug 1 is able to electrically connect to the receptacle 2.

Figure 6:
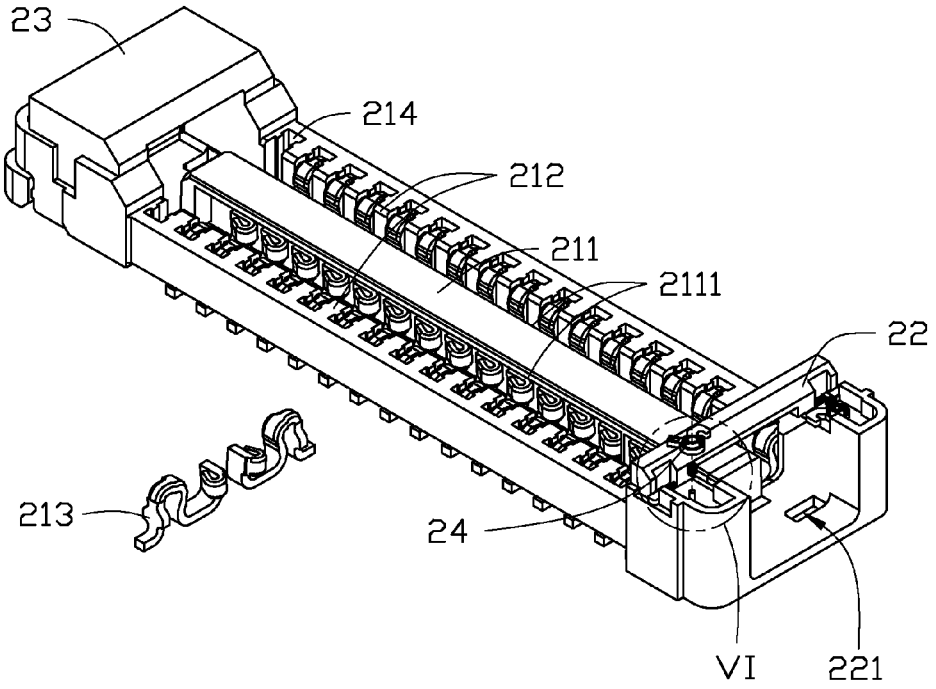
FIG. 6 is a partial exploded, isometric view showing an embodiment of the receptacle of FIG. 1.

FIG. 6 illustrates in at least one embodiment, each side wall 212 of the second main body 21 defines a number of through holes 214 along the direction parallel to the major axis L. Each through hole 214 extends to the flank 2111 along the direction vertical to the major axis L. Therein, each through hole 214 corresponds to one second terminal 213. One end of the second terminal 213 is fixed on the flank 2111, and the other end of the second terminal 213 passes through the through hole 214 and reaches out of the through hole 214.

Figure 5:
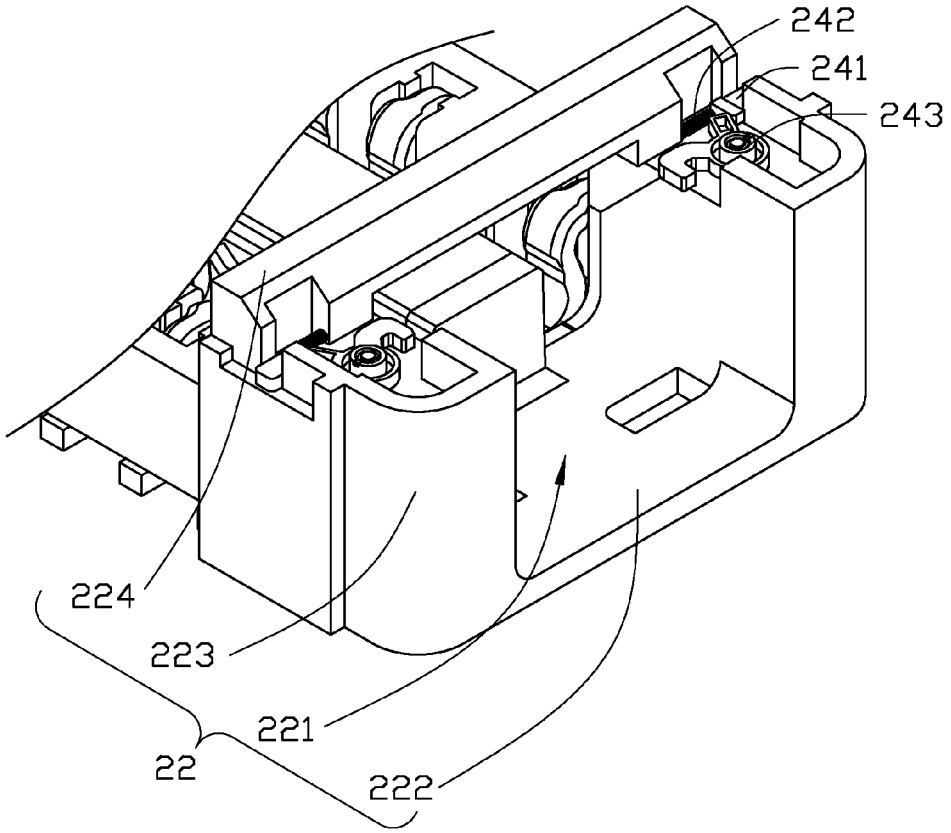
FIG. 5 is an isometric view showing a portion of an embodiment of insert of the receptacle FIG. 1.

FIG. 5 illustrates in at least one embodiment, the insert 22 includes a base plate 222 and two extension blocks 223 vertically extending from the base plate 222. The first gap 221 is formed between the two extension blocks 223. The insert 22 also includes a limiting board 224. The limiting board 224 is set between the two extension blocks 223. The distance between the limiting board 224 and the base plate 222 is equal to the height of the first main body 11. The limiting board 224 is used to make the first terminals 113 closely connect to the second terminals 213 along with the support 23 when the plug 1 slides into the receptacle 2 via the rail 211.

Figure 7:
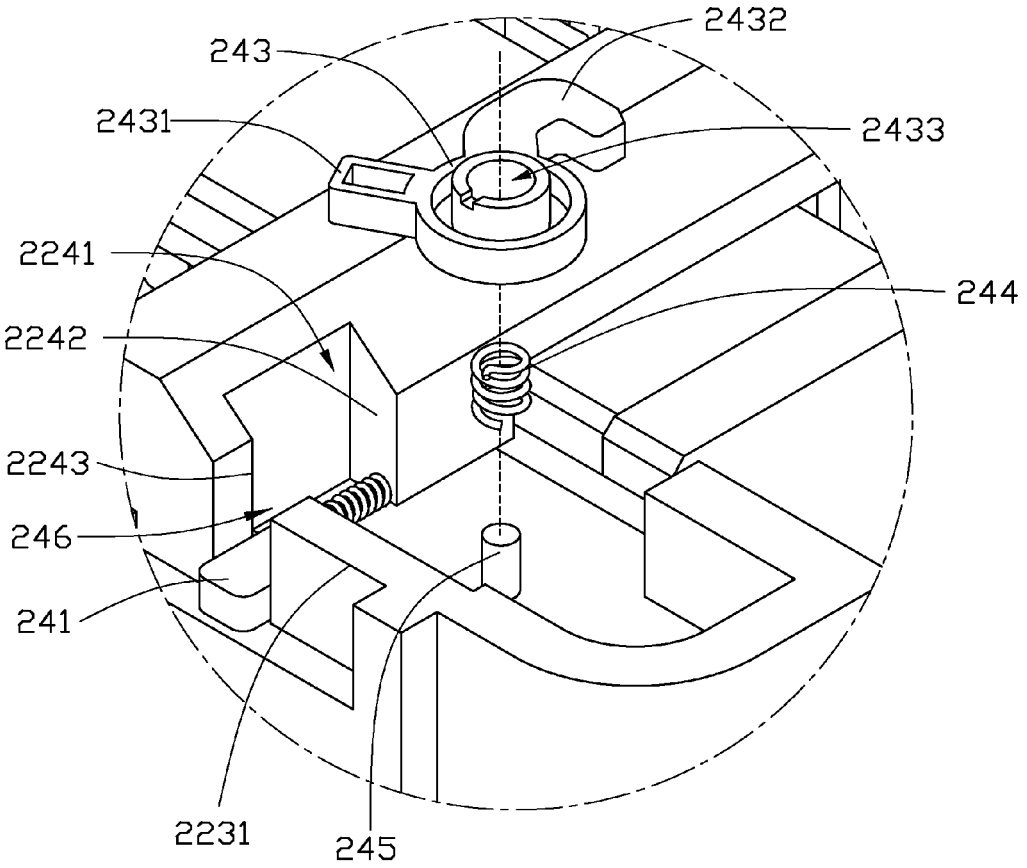
FIG. 7 is an enlarged view of VI area of FIG. 6.

FIG. 7 illustrates in at least one embodiment, the receptacle 1 includes a recoil mechanism 24, used to push out the plug 1 from the receptacle 2. The recoil mechanism 24 includes a pair of pressing blocks 241, a pair of column springs 242, a pair of rotating parts 243, and a pair of torsion springs 244. The recoil mechanism 24 is located on the two extension blocks 223 symmetrically. In at least one embodiment, each extension block 223 includes a fixed column 245. One end of the torsion spring 244 connects to the fixed column 245, and the other end of the torsion spring 244 connects to the rotating part 243, thus the rotating part 243 is rotatably positioned on the extension block 223. One end of the column spring 242 connects to the limiting board 224, and the other end of the column spring 242 connects to the pressing block 241. The pressing block 241 holds the rotating part 243.

Figure 8:
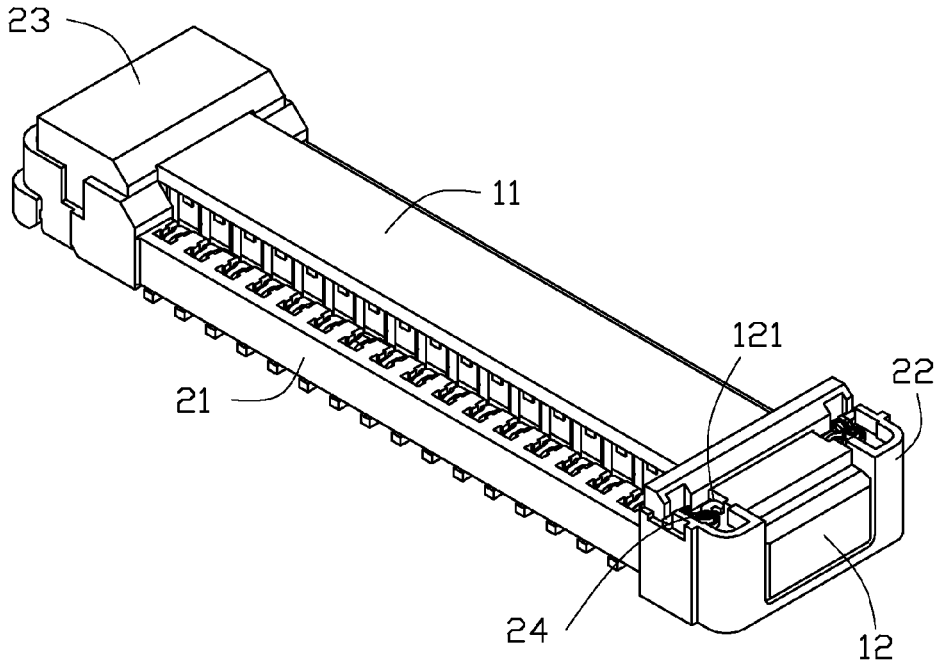
FIG. 8 is an isometric view showing the plug connecting with the receptacle.

FIG. 8 illustrates an isometric view showing the plug 1 connecting with the receptacle 2. When a force is exerted on the pressing block 241, the pressing block 241 is able to move to overcome the elastic force of the column spring 242. The column spring 242 which is connected to the pressing block 241 is compressed and the pressing block 241 rotates the rotating part 243. The torsion spring 244 which is connected to the rotating part 243 is also compressed. During the rotation of the rotating part 243, the rotating part 243 pulls the plug 1 from the receptacle 2. When the force is released on the pressing block 241, the pressing block 241 is able to restore to an original state by the restoring force of the column spring 242, and the rotating part 243 is able to restore to an original state by the restoring force of the torsion spring 244.

Each end of the limiting board 224 defines a slot 2241. The slot 2241 includes the first slot wall 2242 and the second slot wall 2243. The first slot wall 2242 stretches relative to the second slot wall 2243. Each extension block 223 forms an extension wall 2231 extended from the corresponding extension block 223. A second gap 246 is defined between the extension wall 2231 and the second slot wall 2243. One end of the column spring 242 connects to the first slot wall 2242, and the other end of the column spring 242 connects to the pressing block 241. The pressing block 241 is partially out from the second gap 246.

The rotating part 243 includes a push piece 2431 and a hook piece 2432. The pressing block 241 holds the push piece 2431 of the rotating part 243. The rotating part 243 defines a second accommodation space 2433. The second accommodation space 2433 is used to receive the fixed column 245 and the torsion spring 244. In at least one embodiment, the push 12 defines a third gap 121 matching the hook piece 2432. The third gap 121 is configured to be hooked by the hook piece 2432.

In at least one embodiment, when a user connects the plug 1 with the receptacle 2, the user first places the plug 1 into the insert 22 of the receptacle 2 from the first gap 221, then pushes the push 12 of the plug 1 to make the first main body 11 slide into the second main body 21 via the rail 211 of the receptacle 2 until the first main body 11 holds the support 23. When the first main body 11 holds the support 23, the push 12 is received into the first gap 221.

When a force is exerted on the pressing block 241, the pressing block 241 is able to move to overcome the elastic force of the column spring 242. The column spring 242 which is connected to the pressing block 241 is compressed and the pressing block 241 rotates the rotating part 243. The torsion spring 244 which is connected to the rotating part 243 is also compressed. The hook piece 2431 of the rotating part 243 is able to hook the third gap 121 and pulls the plug 1 from the receptacle 2 during the rotation process. When the force is released on the pressing block 241, the pressing block 241 is able to restore to an original state by the restoring force of the column spring 242, and the rotating part 243 is able to restore to original state by the restoring force of the torsion spring 244.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A connector comprising:

a plug comprising a first main body comprising a groove and two slot walls, each of the two slot walls defining a plurality of first terminals;

a receptacle comprising:

a support configured to hold the first main body;

a second main body comprising a rail matching with the groove of the first main body, the rail comprising two flanks, each of the two flanks defining a plurality of second terminals corresponding to the first terminals; and an insert having a first gap;

when the first main body slides into the second main body via the rail from the first gap of the insert in a horizontal direction and is held by the support, each of the plurality of first terminals on the respective slot wall of the first main body connects to one of the plurality of second terminals on each flank of the rail to make the plug electrically connect to the receptacle;

wherein one end of the second main body is connected to the support and the other end of second main body is connected to the insert.

2. The connector according to claim 1, wherein the plug further comprises a push configured to manually push the plug into the receptacle and pull the plug from the receptacle.

3. The connector according to claim 2, wherein the insert further comprises a base plate and two extension blocks vertically extended from the base plate, between the two extension blocks defines the first gap.

4. The connector according to claim 3, wherein the insert comprises a limiting board, the limiting board is set between the two extension blocks.

5. The connector according to claim 4, wherein the receptacle further comprises a recoil mechanism configured to push out the plug from the receptacle, the recoil mechanism is located on the two extension blocks symmetrically, the recoil mechanism comprises a pair of pressing blocks, a pair of column springs, a pair of rotating parts, and a pair of torsion springs.

6. The connector according to claim 5, wherein each extension block defines a fixed column, the rotating part defines a second accommodation space configured to receive the fixed column and the torsion spring, one end of the torsion spring connects to the fixed column and the other end of the torsion spring connects to the rotating part, one end of the column spring connects to the limiting board and the other end of the column spring connects to the pressing block, the pressing block holds the rotating part.

7. The connector according to claim 5, wherein the rotating part comprises a push piece and a hook piece, the pressing block holds the push piece of the rotating part.

8. The connector according to claim 2, wherein the push defines a third gap matching with the hook piece.

9. The connector according to claim 1, the second main body further comprises two side walls, between each one side wall and the rail defines a first accommodation space, the first accommodation space is configured to receive one slot wall of the first main body.

10. The connector according to claim 9, wherein each side wall defines a number of through holes, each through hole corresponds to one second terminal, and one end of each second terminal is fixed on the flank of the rail and the other end of each second terminal passes through and reaches out of the through hole corresponding to the second terminal.

* * * * *